US005735508A

United States Patent [19]

Lancour et al.

[11] Patent Number: 5,735,508

[45] Date of Patent: Apr. 7, 1998

[54] TIE AND METHOD FOR SECURING FENCE FABRIC TO SUPPORTS

[76] Inventors: Jeffrey J. Lancour, 1646 17.4 Rd., Escanaba, Mich. 49829; Ronald D. Chouinard, 605 Dakote Ave.; Carl J. Wick, 7082 P. Rd., both of Gladstone, Mich. 49837

[21] Appl. No.: 686,283

[22] Filed: Jul. 25, 1996

[51] Int. Cl.[6] ..... B21F 7/00; E04H 17/00

[52] U.S. Cl. ..... 256/57; 256/47

[58] Field of Search ..... 256/57, 48, 47, 256/46, 32, 33, 35, 34, 56; 24/546, 548, 67.9; 403/397, 214

[56] References Cited

U.S. PATENT DOCUMENTS

| | | | |
|---|---|---|---|
| 1,849,410 | 3/1932 | Selquist | 256/57 X |
| 1,943,261 | 1/1934 | Knutson | 256/57 X |
| 2,247,631 | 7/1941 | Gardner | 256/57 |
| 2,705,130 | 3/1955 | Bimson | 256/48 |
| 2,968,490 | 1/1961 | Pellerito et al. | 256/47 |
| 3,317,190 | 5/1967 | Duff | 256/48 |
| 3,394,922 | 7/1968 | Bradbury | 256/57 |
| 3,901,480 | 8/1975 | Basile et al. | 256/32 |
| 4,201,013 | 5/1980 | Robbins | 256/57 X |
| 4,492,364 | 1/1985 | Boyanton | 256/32 X |
| 4,899,990 | 2/1990 | Winders et al. | 256/57 |
| 5,275,383 | 1/1994 | Wick et al. | 256/57 |

*Primary Examiner*—Harry C. Kim
*Attorney, Agent, or Firm*—John R. Benefiel

[57] ABSTRACT

A tie is disclosed for connecting fence fabric to a post in which a pair of legs are joined at one end by a connecting section, one leg formed with corners receiving strands of the fence fabric, the other leg curved to fit the post. The legs are extended parallel to the plane of the fence with one leg over the fence fabric and the other over the post, and the ends twisted together to secure the fence fabric to the post. The twisted ends are flat to the fence to eliminate the hazard presented by protruding ends.

5 Claims, 1 Drawing Sheet

TIE AND METHOD FOR SECURING FENCE FABRIC TO SUPPORTS

BACKGROUND OF THE INVENTION

This invention concerns fencing, and more particularly wire ties and methods of securing chain link fabric to line and cross posts.

The recent increased prison and security fence construction has created a need for low cost but secure fencing. Chain link fabric is low in cost and is preferred for this application.

In U.S. Pat. No. 5,275,383 issued on Jan. 4, 1994 for a "METHOD AND WIRE TIE CONNECTION FOR SECURING FENCING FABRIC TO POSTS" there is described a wire tie connection which features small radius corners which capture fencing wire strands and draw the same very securely to the post as the ends of the tie are twisted together.

In the arrangement shown in that patent, the twisted ends of the installed tie project from the plane of the fence. These projecting ends create a potential hazard to passersby on the back side of the fence where the fencing encloses high traffic areas. To avoid this problem, the twisted ends must be bent over manually, a laborious, time consuming task.

Conventional ties consisting of a simple U-shape have been twisted while extending to one side, capturing a single strand against the post. This approach fails to fasten the fence fabric securely as described in the above referenced patent. Furthermore, the twisted tie can be turn out of the plane of the fence to project outwardly and present a hazard.

It is an object of the present invention to provide a wire tie for connecting chain link fencing fabric to a post which allows a side mounted orientation which securely fastens the fence fabric tightly to the post and preventing the tie from turning out of the plane of the fence.

SUMMARY OF THE INVENTION

The present invention achieves this object by a tie configured in a very general U-shape having a pair of leg segments connected at one end by a joining section.

Each of the legs are diversely shaped from each other.

One leg segment forms a first small radius corner where joined to the connecting section, and a second small radius corner is formed spaced from the first corner a distance approximately equal to the diameter of the post. The other leg segment has a curved section of a radius adapted to be fit around the post diameter. The free end of each leg is angled outwardly from the other.

In making a tie. Pence connection, the tie is placed around one side of a post with one leg segment extending over the fence fabric and the other leg segment around the opposite side of the post. Two of the fence fabric strands are received in respective small radius corners of the one leg segment. The free ends are twisted together to draw the fence fabric against one side of the post, with the twisted ends extending in the same direction as the fence fabric.

The tie twisted free ends are prevented from being turned outwardly by the engagement of the small radius corners with the adjacent spaced fence fabric strands.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
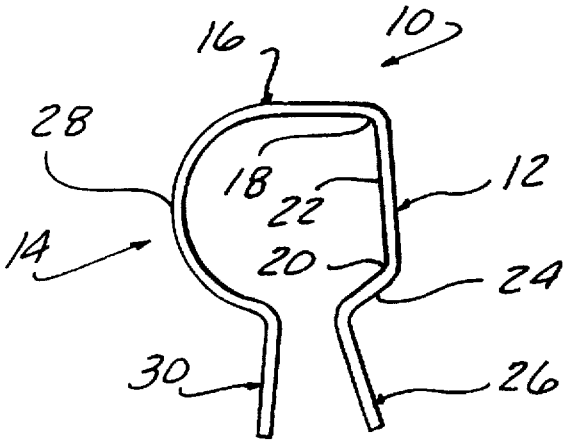
FIG. 1 is a plan view of a fence tie according to the invention prior to being installed.

Referring to FIG. 1, the fence tie 10 according to the invention comprises a generally U-shaped piece of formed wire.

Suitable wire is a heavy gauge aluminum, aluminized steel, galvanized steel, or stainless steel. Six to nine gauge wire has been found to be satisfactory.

The wire tie 10 has a pair of side-by-side diversely shaped leg segments 12 and 14 joined at one end by a connecting section 16 both leg segments extending away from the connecting section 16 in the same general direction.

The leg segment 12, to the right as viewed in FIG. 1, has a relatively small radius first corner 18 formed by the juncture of its fixed end with one side of the substantially straight connecting section 16. A second small radius corner 20 is spaced from the first corner 18 a distance equal to or slightly greater than the diameter of a post on which the tie 10 is to be installed. A substantially straight section 22 of leg 12 extends between the two corners 18, 20. The second corner 20 is formed by the leg straight section 22 and an inwardly inclined section 24. An outwardly flared section 26 forms a free end of leg segment 12.

The first and second corners 18, 20, 16 are shaped with an inside radius on the order of one half inch, i.e., within the approximate range of from three-eighths to five-eighths of an inch. This radius allows the distance between each leg 12, segments 14 to be shortened slightly as the legs 12 are twisted tight, as described below, while still gripping the fencing strands as described.

The other leg segment 14, on the left as viewed in FIG. 1, is formed with a relatively large radius curved section 28, one end blending into the substantially straight connecting section 16, the other end joined to an outwardly flaring section 30 forming the tree end of the leg 14. The radius of the curved section 28 is matched to that of the post on which the tie 10 is to be installed, producing a distance across the curved section 30 which, approximates the distance between the first and second corners 18, 20.

Installation involves positioning the tie straddling both the post 32 and a section of the fence fabric 34 so that the leg segment 12, 14 extend in the same general direction as the plane of the fence fabric 34 and normal to two strands 36A, 36B of the fence fabric. One leg segment 12 overlies the strands 36A, 36B, which are approximately positioned in the corners 18, 20. The other leg 14 overlies the post 32, the curved section 28 fit to the diameter of the post 32.

Figure 2:
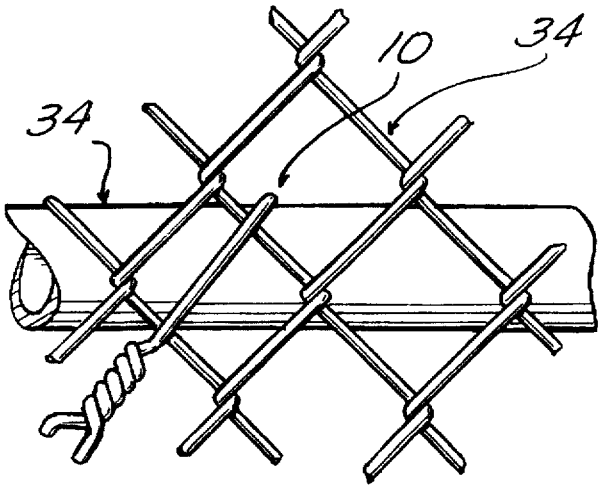
FIG. 2 is a fragmentary view of a fence section showing the fence tie of FIG. 1 after having been installed on a cross post.
Figure 3:
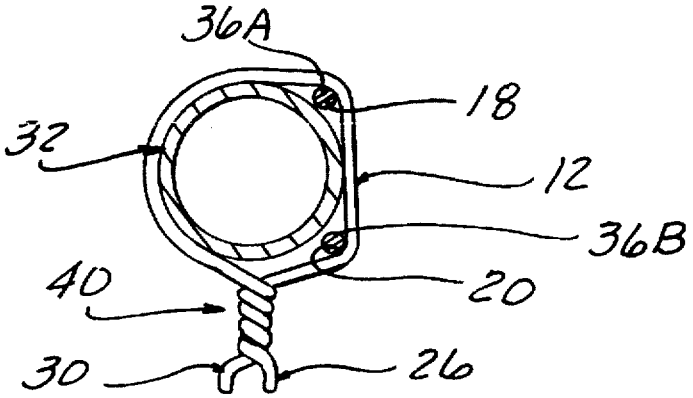
FIG. 3 is a transverse sectional view taken through post and fence fabric strands, showing the fence tie according to the invention installed thereon.

FIG. 2 shows a tie 10 installed on a cross post 32 and on a section of fabric fencing 34 overlying one side of the post. Two strands 36A, 36B are pulled into the inside of corners 18, 20 as the straight section 12 is drawn against the cross post 32 by twisting together of the free ends 26, 30 to form a pig tail 40.

The curved section 28 is fit tightly against the otherside of the post 32 from the side which is overlain by the fence fabric.

Twisting together of the free ends 26, 30 of the leg segments 12, 14 is preferably powered by use of a tool having holes receiving the free ends 26, 30 of the leg segments 12, 14 which are squeezed together to be inserted into the tool (not shown). A power drill (not shown) is used to rotate the tool as described in the above referenced patent.

Where the corners 18, 20 are not initially perfectly aligned with strands 36A, 36B, twisting of the ends 26, 30 causes the corners 18, 20 to travel to capture these strands as the tie is twisted tight.

The installed tie 10 generally disposes the pigtail 40 in the plane of the fence fabric section 34. This eliminates the need for a separate step of bending the pigtail 40 over in order to minimize the hazard presented by an outwardly projecting orientation.

The engagement of two spaced strands 36A, 36B with the spaced corners 18, 20 prevents the tie 10 from thereafter turning out of the plane of the fence.

At the same time, the secure, tight connection achieved by the tie according to the above patent is also achieved by this tie configuration.

We claim:

1. A wire tie for connecting wire fabric fencing to a post comprising:

a length of wire having a pair of side-by-side elongated leg segments joined at one end by a substantially straight connecting section, said leg segments both extending away from said connecting section in the same general direction to form a generally U-shaped tie;

one leg segment having a substantially straight section joined to one end of said connecting section so as to form a first corner, and an inwardly inclined section joined at one end to said straight section of said one leg segment to form a second corner spaced from said first corner;

the other leg segment having a curved section having a radius and with one end thereof joined to said other end of said connecting section;

said one of said leg segments having a free end connected to another end of said inwardly inclined section, said other of said leg segments having a free end connected to another end of said curved section, both of said free ends extending away from said connecting section of said tie and wherein said free ends are configured to be twisted together to connect said free ends together.

2. The wire tie according to claim 1 wherein said first and second corners are each formed with a much smaller radius than said radius of said curved section of said other leg segment.

3. The wire tie according to claim 2 wherein a distance across said curved section of said other leg segment is approximately equal to the spacing between said first and second corners of said one leg segment.

4. The wire tie according to claim 1 wherein said free end of said one leg segment is inclined outwardly from said straight section and said free end of said other leg segment is inclined outwardly from said curved section.

5. A method of forming a connection between a section of wire fence fabric and a post, said fabric comprised of a pattern of wire strands having segments at a uniform spacing and overlying said post, said method comprising the steps of forming a generally U-shaped wire tie having a pair of side-by-side elongated leg segments connected at one end by a connecting segment, the other ends of said leg segments free, one of said leg segments forming a first corner at a point joining said connecting segment, said one leg further formed with a second corner spaced from said first corner a distance approximately equal to the distance between two adjacent strand segments in said fence fabric pattern, the other of said leg segments formed with a curved segment of a radius sized to be fit over one side of said post,;

placing said wire tie around said post with said leg segments extending in the same direction as said fence fabric with said one leg segment extending over said fence fabric to approximately position said first and second corners over respective adjacent strand segments in said fence fabric pattern, and said other leg segment fit around the opposite side of said post from said one side; and, twisting said leg segment free ends together to draw two strand segments of said fence fabric respectively into said first and second formed corners and to thereby draw said fence fabric tight against said one side of said post as said leg segments are twisted together, said twisted ends thereby forming a pigtail extending generally parallel to said fence fabric.

* * * * *